US005960493A

United States Patent [19]

Rhey et al.

[11] Patent Number: 5,960,493

[45] Date of Patent: Oct. 5, 1999

[54] SAFETY BUMPER PAD

[75] Inventors: Hans M. Rhey; Karen D. Rhey, both of Gilbert, Ariz.; Terry L. Lyons, 925 S. Scallop Dr., Gilbert, Ariz. 85233

[73] Assignee: Terry L. Lyons, Gilbert, Ariz.

[21] Appl. No.: 09/108,052

[22] Filed: Jun. 30, 1998

[51] Int. Cl.[6] ..... A47C 21/08

[52] U.S. Cl. ..... 5/424; 5/425; 5/426; 5/427; 5/663; 5/946

[58] Field of Search ..... 5/946, 663, 424, 5/425, 426, 427, 494

[56] References Cited

U.S. PATENT DOCUMENTS

| | | | |
|---|---|---|---|
| 4,742,821 | 5/1988 | Wootan | 5/494 X |
| 5,010,611 | 4/1991 | Mallett | 5/497 |
| 5,241,718 | 9/1993 | Pope | 5/424 |
| 5,410,765 | 5/1995 | Dicken | 5/93.1 |
| 5,542,135 | 8/1996 | Ozrovitz et al. | 5/424 |
| 5,706,534 | 1/1998 | Sherman | 5/946 X |
| 5,806,112 | 9/1998 | Harms | 5/424 X |

FOREIGN PATENT DOCUMENTS

| | | | |
|---|---|---|---|
| 14908 | of 1898 | United Kingdom | 5/498 |

*Primary Examiner*—Terry Lee Melius
*Assistant Examiner*—Rodrigo J. Morales
*Attorney, Agent, or Firm*—Donald J. Ersler

[57] ABSTRACT

A safety bumper pad includes a bumper pad, a mattress retaining sheet, and a plurality of positive locking straps. A bumper cover is sewn around a bumper cushion to form the bumper pad. The mattress retaining sheet is sewn on the bottom of the bumper pad such that a mattress may be inserted therein. The mattress retaining sheet is deep enough to allow the entire bumper pad to protrude above the mattress. A plurality of positive locking straps are attached to substantially the top of the bumper pad. The positive locking straps include a strap portion, a female locking member, and a male locking portion. The female locking member is attached to one end of the strap portion. The male locking member contains a loop section through which the other end of the strap portion is inserted. The male and female locking members are pulled around at least one crib rail and then the male locking member is inserted into the female locking member. A loose end the strap portion is pulled tight to hold the bumper pad against the crib rail.

15 Claims, 4 Drawing Sheets

SAFETY BUMPER PAD

BACKGROUND OF THE INVENTION

1. Field of the Invention

The present invention relates generally to bumper pads and more specifically to a safety bumper pad which prevents an infant from pushing an arm or leg through a crib side wall.

2. Discussion of the Prior Art

There have been several attempts at producing a bumper pad which prevents an infant from pushing an arm or leg through a crib side wall. U.S. Pat. No. 5,010,611 to Mallett discloses a fitted safety crib sheet integral bumper liner. U.S. Pat. No. 5,410,765 to Youngblood discloses a crib bumper pad. Both of these designs use fabric straps to fasten the bumper pad to the crib side wall. These fabric straps must be tied and untied. Further, the most common way of tying the fabric straps is using a bow knot.

Unfortunately, infants are capable of reaching over the bumper pad and untying the bow knots. Infants are also capable of untying the bow knot by pulling or tugging on the bumper pad. In some cases, the fabric straps may be torn off the bumper pad by infant tugging. If a baby is successful at untying the bow knot, the baby will be able to pull down the bumper pad and push an arm or leg through the crib side wall. Even worse, if the baby unties bow knots on at least one side of the crib, the baby may push or throw the bumper pad out of the crib.

Accordingly, there is a clearly felt need in the art for a safety bumper pad which prevents an infant from pushing an arm or leg through a crib side wall, allows the safety bumper pad to be easily attached to and detached from a crib, and provides an attachment device which cannot be detached by an infant.

SUMMARY OF THE INVENTION

The primary objective of the present invention is to provide a safety bumper pad which prevents an infant from pushing an arm or leg through a crib side wall, allows the safety bumper pad to be easily attached to and detached from a crib, and provides an attachment device which cannot be detached by an infant.

According to the present invention, a safety bumper pad includes a bumper pad, a mattress retaining sheet, and a plurality of positive locking straps. A bumper cover is sewn around a bumper cushion to form the bumper pad. The mattress retaining sheet is sewn on the bottom of the bumper pad such that a mattress may be inserted therein. The mattress retaining sheet is deep enough to allow the entire bumper pad to protrude above the mattress. A plurality of positive locking straps are attached near the top of the bumper pad. The positive locking straps include a strap portion, a female locking member, and a male locking member. The strap portion is slipped through a loop which is fastened near the top of the bumper pad. The female locking member is attached to one end of the strap portion. The male locking member contains a loop section through which the other end of the strap portion is inserted.

The safety bumper pad is installed in a crib by placing a sheet over a mattress and then inserting the mattress inside the safety bumper pad. The safety bumper pad and mattress are inserted into the crib. Next, the strap portion of each positive locking strap is wrapped around at least one crib rail. The plurality of female locking members are joined to the plurality of male locking members. The loose end of each strap portion is pulled tight while retaining the bumper pad at the proper height. When the safety bumper pad needs to be removed, a thumb and forefinger are used to compress the fingers of each male locking member. The male locking members are slide out of the female members. The safety bumper pad is then removed from the crib.

Accordingly, it is an object of the present invention to provide a safety bumper pad which prevents an infant from pushing its arm or leg through the side wall of a crib.

It is a further object of the present invention to provide a safety bumper pad which provides attachment means for efficient installation and removal of the safety bumper pad from a crib.

It is yet another object of the present invention to provide a safety bumper pad which makes it virtually impossible for an infant to detach the attachment means which holds the safety bumper pad in the crib.

It is yet another object of the present invention to provide a safety bumper pad which does not allow an infant to untie bow knots by pulling or tugging on the bumper pad.

It is yet another object of the present invention to provide a safety bumper pad which does not allow an infant to tear fabric straps from the bumper pad.

It is yet another object of the present invention to provide a safety bumper pad which does not allow an infant to bump its head on the crib side walls or bars.

It is yet another object of the present invention to provide a safety bumper pad which does not allow an infant to push or throw the bumper pad out of the crib.

It is yet another object of the present invention to provide a safety bumper pad which does not allow an infant to reach over the bumper pad and untie the bow knots.

Finally, it is another object of the present invention to provide a safety bumper pad which may be easily cleaned in a washing machine.

These and additional objects, advantages, features and benefits of the present invention will become apparent from the following specification.

DETAILED DESCRIPTION OF THE PREFERRED EMBODIMENTS

Figure 1:
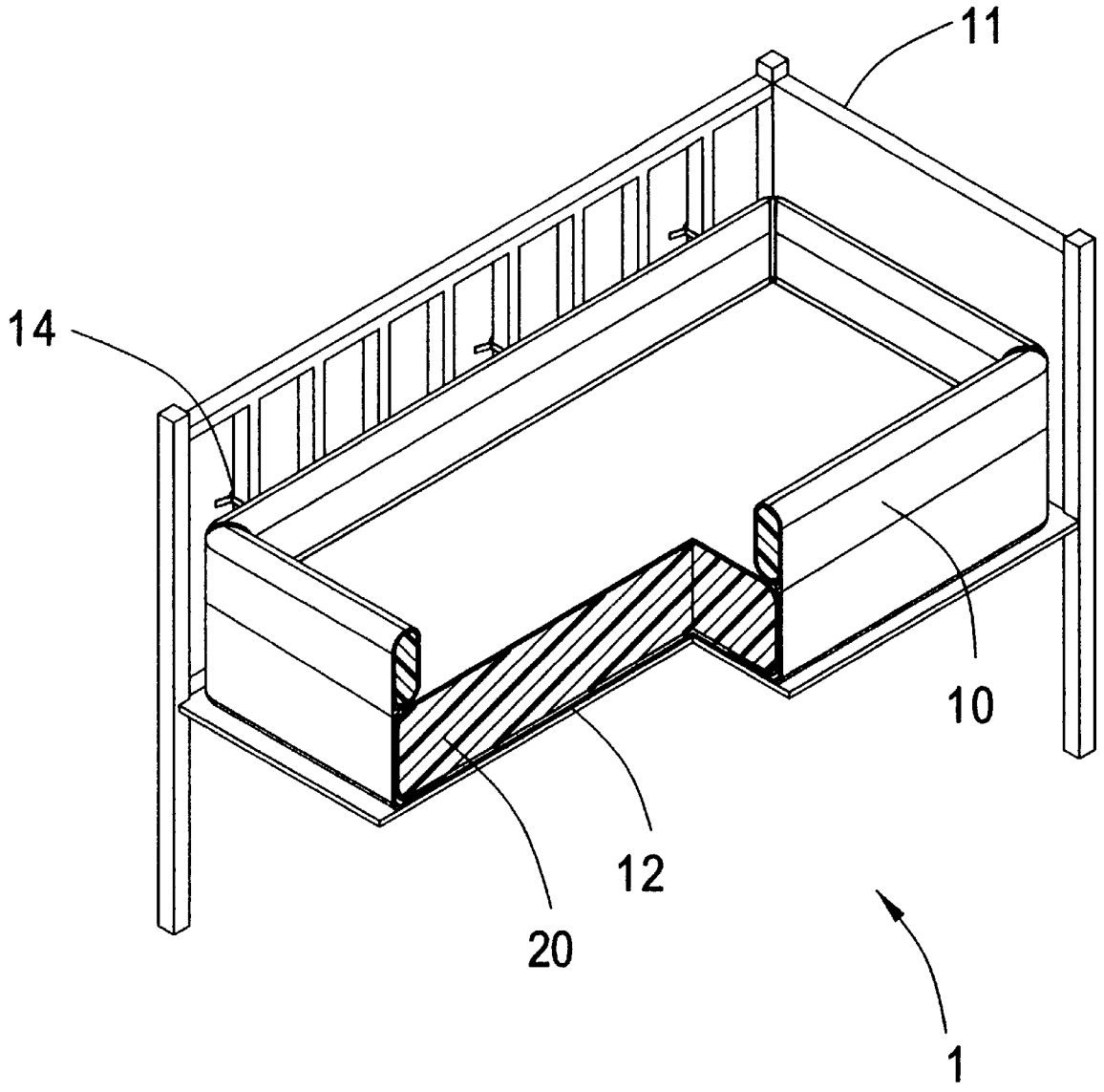
FIG. 1 is a cut-away perspective view of a safety bumper pad installed in a crib in accordance with the present invention.
Figure 2:
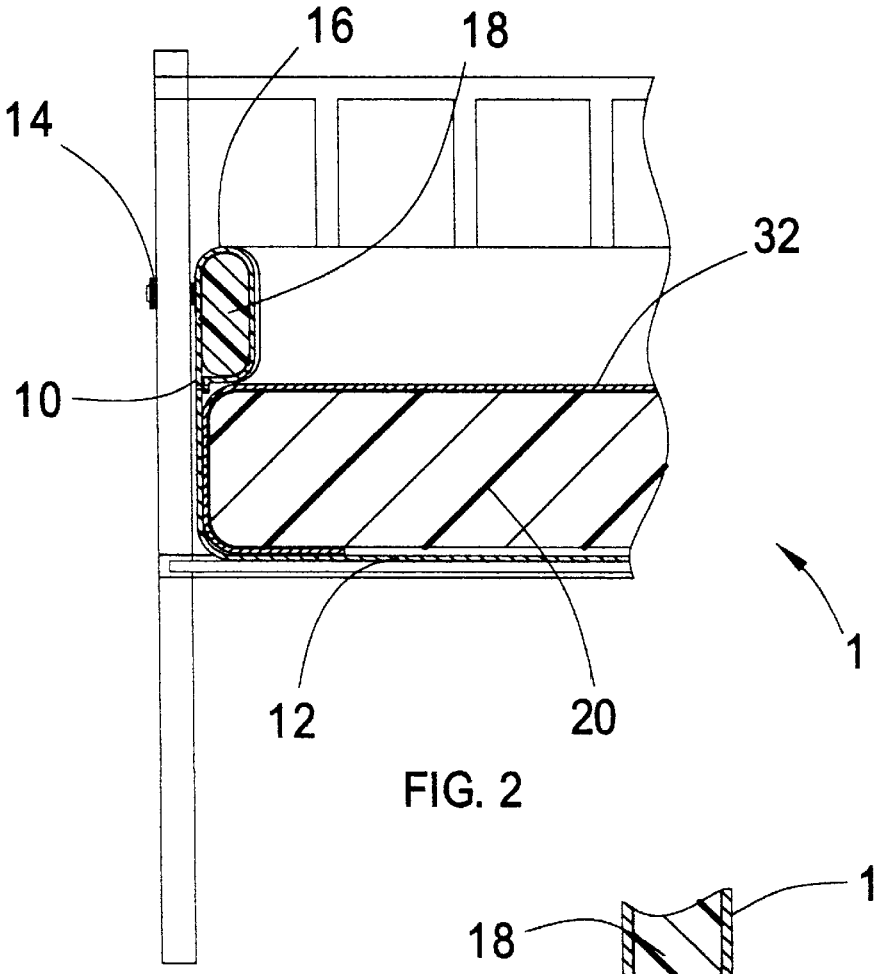
FIG. 2 is a partial cross sectional view of a safety bumper pad installed in a crib in accordance with the present invention.

With reference now to the drawings, and particularly to FIGS. 1 and 2, there is shown a cut-away perspective view of a safety bumper pad 1. The safety bumper pad 1 includes a bumper pad 10, a mattress retaining sheet 12, and a plurality of positive locking straps 14. A bumper cover 16 surrounds a bumper cushion 18 to form the bumper pad 10. The bumper cushion may be fabricated out of cotton, a synthetic blend, foam or any soft washable material. The bumper cover 16 may be attached to the bumper cushion 18 with any suitable fastening method such as sewing, fusing, or cement. The mattress retaining sheet 12 may be attached to a bottom of the bumper pad 10 with any suitable fastening method such as sewing, fusing, or cement. The mattress retaining sheet 12 may also be a single piece of material which is integral to the bumper cover 16. The mattress retaining sheet 12 is deep enough to allow the entire bumper pad 10 to protrude above a mattress 20. The mattress retaining sheet 12 and the bumper cover 16 are preferably fabricated from a material which is easily washable and will not cause an infant to have an allergic reaction.

Figure 2A:
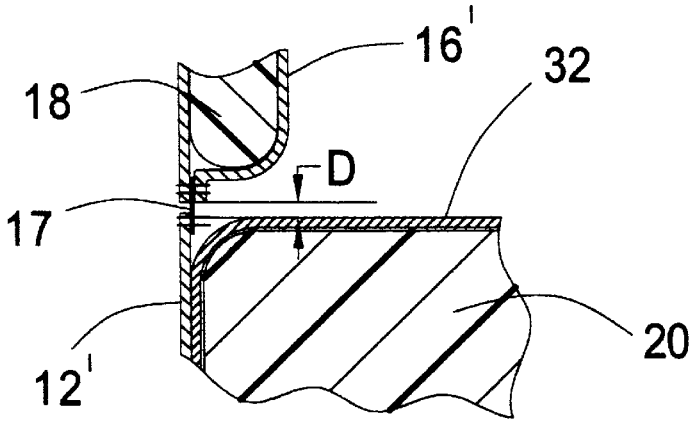
FIG. 2*a* is a partial enlarged cross sectional view of a bumper cover which is attached to a mattress sheet with an elastic strip in accordance with the present invention.
Figure 3A:
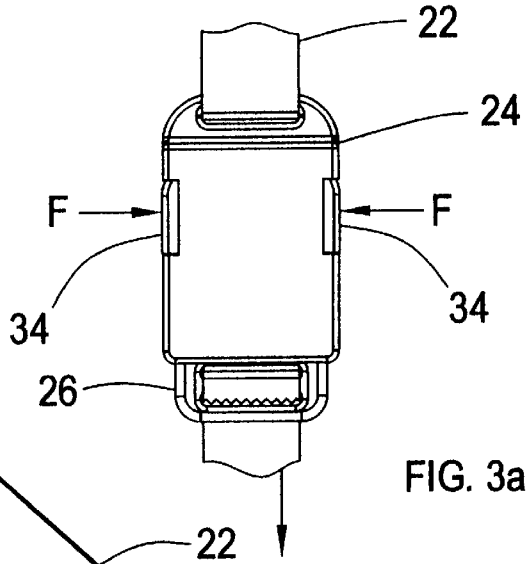
FIG. 3*a* is a top view of a male and a female locking member of a positive locking strapped in a locked position in accordance with the present invention.
Figure 3:
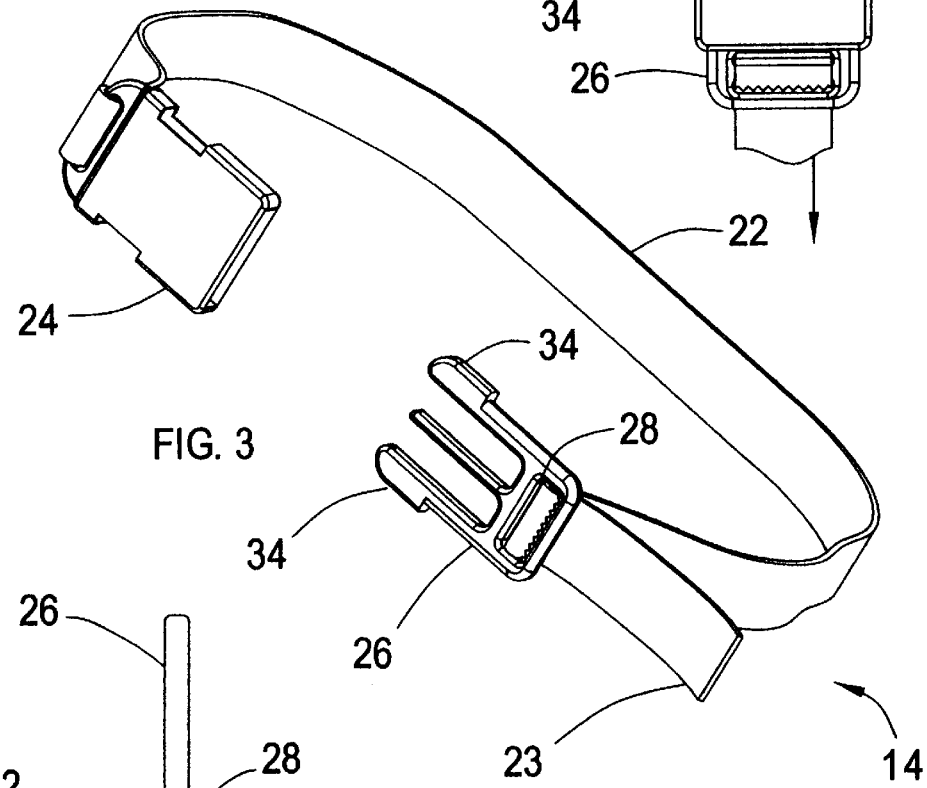
FIG. 3 is a perspective view of a positive locking strap in accordance with the present invention.
Figure 3B:
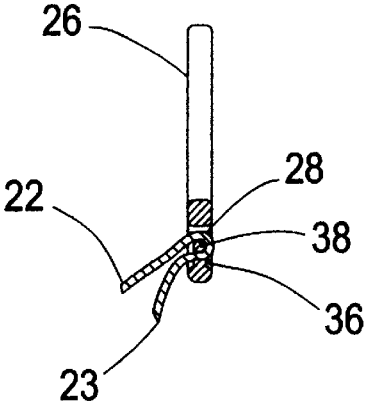
FIG. 3*b* is a cross sectional view of a male locking member in accordance with the present invention.

FIG. 2*a* shows a partial enlarged cross sectional view of a bumper cover 16' which is attached to a mattress sheet 12' with an elastic strip 17. The bumper cover 16' is attached to one end of the elastic strip 17 with any suitable fastening method such as sewing, fusing, or cement. The mattress sheet 12' is attached to an opposite end thereof with any suitable fastening method such as sewing, fusing, or cement. The bottom of the bumper sheet 16' is preferably a distance "D" above the top of the mattress 20. A value for distance "D" is given by way of example and not limitation. Distance "D" is preferably ¼ of an inch. The elastic strip 17 facilitates better fitting of the mattress sheet 12 around the mattress 20.

Figure 4:
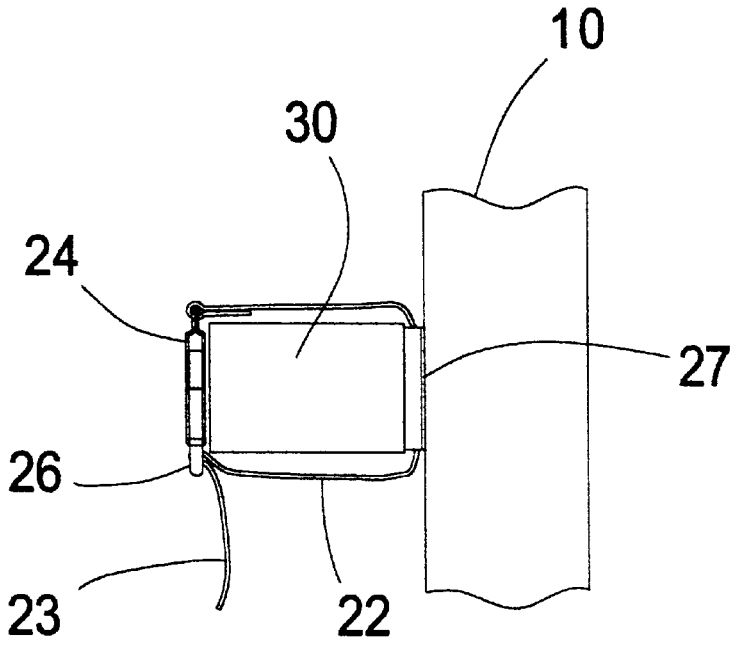
FIG. 4 is a top view of a positive locking strap fastened around a crib rail in accordance with the present invention.
Figure 5:
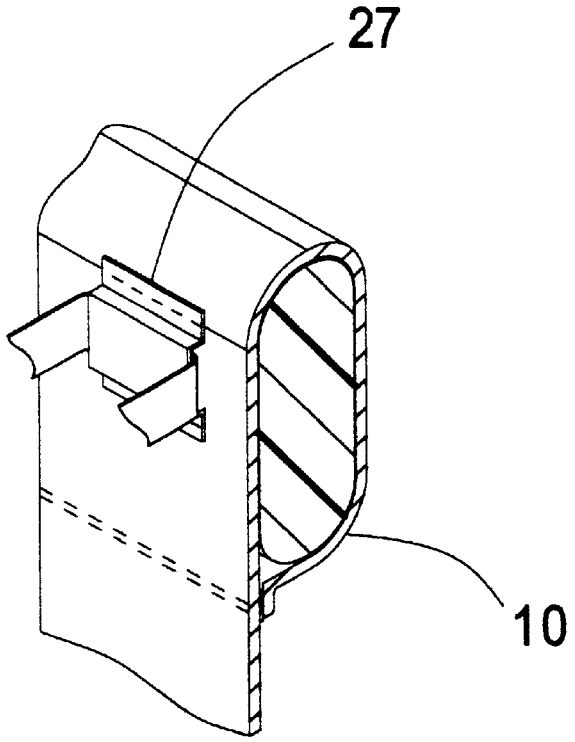
FIG. 5 is a perspective view of a strap portion of a positive locking strap insert ed through a loop on a bumper pad in accordance with the present invention.

With reference to FIGS. 3, 3*a*, 3*b*, and 5, the plurality of positive locking straps 14 are attached to substantially the top of the bumper pad. Each positive locking strap 14 includes a strap portion 22, a female locking member 24, and a male locking portion 26. The strap portion 22 is slipped through a loop 27 which is fastened to substantially the top of the bumper pad 10. The female locking member 24 is attached to one end of the strap portion 22. The male locking member 26 contains a loop section 28 through which the strap portion 22 is inserted. The loop section 28 includes a serrated edge 36 and a strap cross member 38. The serrated edge 36 and the strap cross member 38 allow a loose end 23 of the strap portion 22 to be pulled tight around a crib rail 30 as shown in FIG. 4. The serrated edge 36 digs into the loose end 23 to prevent a loss of tension.

The loop section 28 may be alternatively formed in the female locking member 24 instead of the male locking member 26, or in both female and male locking members. The female and male locking members are commonly available from a variety of manufacturers. The invention should not be limited to the use of the particular locking device shown, but could include any positive locking devices which are on the market presently, or that will be invented. The only requirement for the locking device is that an infant is not capable of unlocking thereof. It is also possible to substitute pairs of fabric straps for the positive locking straps as disclosed in many prior art bumper pads. Each pair of fabric straps are tied around at least one crib rail to hold the bumper pad 10 in place. The strap portion 22 of the positive locking strap 14 may also be fastened directly to the bumper pad 10 at substantially the top thereof. This would eliminate the need for the loop 27. However, the ability to remove the positive locking strap 14 from the bumper pad 10 provides for ease of washability.

The safety bumper pad 1 is installed in a crib 11 by placing the sheet 32 over the mattress 20 and then inserting the mattress 20 inside the safety bumper pad 1. The bumper pad 10 is pulled upward to ensure that the mattress 20 is thoroughly seated in the mattress retaining sheet 12. The safety bumper pad 1 and the mattress 20 are inserted into the crib 11. Next, the strap portion 22 of each positive locking strap 1 is wrapped around at least one crib rail. The plurality of female locking members 24 are joined to the plurality of male locking members 26. The loose end 23 of each strap portion 22 is pulled tight around the crib rail 30 while holding the bumper pad 10 at the proper height. When the safety bumper pad 10 needs to be removed, the fingers 34 of each male locking member 26 are compressed with a thumb and forefinger. Then the male locking member 26 is pulled out of the female locking member 24. Finally, the safety bumper pad 1 is removed from the crib 11.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A safety bumper pad adapted for insertion into a crib comprising:

a bumper pad having a top and a bottom;

a mattress retaining sheet extending from said bottom of said bumper pad;

a plurality of positive locking straps being attached near said top of said bumper pad, a female locking member being disposed at one end of each said positive locking strap, a male locking member being disposed at another end of each said positive locking strap, said locking straps for facilitating the efficient locking and unlocking of said safety bumper pad to the crib;

a plurality of loops being attached to substantially said top of said bumper pad; and said positive locking straps including a strap portion, a male locking member, and a female locking member, each said strap portion being inserted through each said loop, one end of said strap being attached to one locking member, the other end of said strap portion being inserted through an opposite locking member, said bumper pad being fastened to at least one crib rail by tightening a loose end of said strap portion.

2. The safety bumper pad adapted for insertion into a crib of claim 1, further comprising:

said positive locking straps including a strap portion, said male locking member, and said female locking member, one end of said strap portion being attached to one of said locking members, the other end of said strap portion being inserted through an opposite locking member, said bumper pad capable of being fastened to at least one crib rail by tightening a loose end of said strap portion.

3. The safety bumper pad adapted for insertion into a crib of claim 1, further comprising:

said bumper pad having a bumper cover surrounding a bumper cushion.

4. The safety bumper pad adapted for insertion into a crib of claim 3 wherein:

said mattress retaining sheet being fastened to said bottom of said bumper pad.

5. The safety bumper pad adapted for insertion into a crib of claim 3, further comprising:

one end of an elastic strip being attached to said bottom of said bumper pad, an opposite end of said elastic strip being attached to a top of said mattress retaining sheet.

6. The safety bumper pad adapted for insertion into a crib of claim 1, wherein:

said bumper pad and said mattress retaining sheet being fabricated from an easily washable and non-allergic fabric.

7. The safety bumper pad adapted for insertion into a crib of claim 4, wherein:

said bumper pad and said mattress retaining sheet being fabricated from an easily washable and non-allergic fabric.

8. A safety bumper pad adapted for insertion into a crib comprising:

a bumper pad having a top, a bottom, and a plurality of loops attached to said bumper pad near said top thereof;

a mattress retaining sheet extending from said bottom of said bumper pad; and a plurality of positive locking straps, each positive locking strap comprising a strap portion, a female locking member and a male locking member, one end of said strap portion being inserted through one of said loops, said female locking member being attached to one end of said strap portion, said male locking member being attached to an opposite end of said strap portion, said plurality of positive locking straps facilitating the efficient locking and unlocking of said safety bumper pad to the crib.

9. The safety bumper pad adapted for insertion into a crib of claim 8, wherein:

one end of said strap portion being attached to one of said locking members, another end of said strap portion being inserted through an opposite locking member, said bumper pad capable of being fastened to at least one crib rail by tightening a loose end of said strap portion.

10. The safety bumper pad adapted for insertion into a crib of claim 8, further comprising:

said bumper pad having a bumper cover surrounding a bumper cushion.

11. The safety bumper pad adapted for insertion into a crib of claim 10, wherein:

said mattress retaining sheet being fastened to said bottom of said bumper pad.

12. The safety bumper pad adapted for insertion into a crib of claim 10, further comprising:

one end of an elastic strip being attached to said bottom of said bumper pad, an opposite end of said elastic strip being attached to a top of said mattress retaining sheet.

13. A safety bumper pad adapted for insertion into a crib comprising:

a bumper pad having a top and a bottom;

a mattress retaining sheet extending from said bottom of said bumper pad;

one end of an elastic strip being attached to said bottom of said bumper pad, an opposite end of said elastic strip being attached to a top of said mattress retaining sheet; and a plurality of positive locking straps being attached near said top of said bumper pad, a female locking member being disposed at one end of each said positive locking strap, a male locking member being disposed at another end of each said positive locking strap, said locking straps for facilitating the efficient locking and unlocking of said safety bumper pad to the crib;

a plurality of loops being attached near said top of said bumper pad; and said positive locking straps including a strap portion, said male locking member, and said female locking member, one said strap portion being inserted through one said loop, one end of said strap portion being attached to one of said locking members, the other end of said strap portion being inserted through an opposite locking member, said bumper pad capable of being fastened to at least one crib rail by tightening a loose end of said strap portion.

14. The safety bumper pad adapted for insertion into a crib of claim 13, further comprising:

said positive locking straps including a strap portion, said male locking member, and said female locking member, one end of said strap portion being attached to one of said locking members, the other end of said strap portion being inserted through an opposite locking member, said bumper pad capable of being fastened to at least one crib rail by tightening a loose end of said strap portion.

15. The safety bumper pad adapted for insertion into a crib of claim 13, further comprising:

said bumper pad having a bumper cover surrounding a bumper cushion; and said mattress retaining sheet being fastened to said bottom of said bumper pad.

* * * * *